United States Patent [19]

Kuhl

[11] 4,408,625

[45] Oct. 11, 1983

[54] ARTICLE WASHING MEANS WITH MOVABLE SPRAY HEADS

[76] Inventor: Henry Y. Kuhl, Kubl Rd., R.D. 1, Box 485A, Flemington, N.J. 08822

[21] Appl. No.: 375,835

[22] Filed: May 7, 1982

[51] Int. Cl.[3] ..... B08B 3/02

[52] U.S. Cl. ..... 134/144; 134/123; 134/165; 134/172; 134/200

[58] Field of Search ..... 134/123, 144, 165, 172, 134/199, 200

[56] References Cited

U.S. PATENT DOCUMENTS

| | | | |
|---|---|---|---|
| 2,699,792 | 1/1955 | Fisher | 134/56 |
| 2,827,064 | 3/1958 | Heinicke | 134/172 |
| 3,656,493 | 4/1972 | Black et al. | 134/144 X |
| 3,706,317 | 12/1972 | Fox et al. | 134/123 X |
| 4,019,458 | 4/1977 | Kolterer | 134/172 X |
| 4,076,033 | 2/1978 | Busse et al. | 134/172 |
| 4,227,938 | 10/1980 | Fowler | 134/10 |
| 4,287,901 | 9/1981 | Fowler | 134/200 X |
| 4,299,245 | 11/1981 | Clapper | 134/144 X |

*Primary Examiner*—Robert L. Bleutge
*Attorney, Agent, or Firm*—Frederick A. Zoda; John J. Kane

[57] ABSTRACT

An article washing device is disclosed which includes movable spray heads for both washing and rinsing while the article is stationary or moving. The housing is defined with the washing compartment therein having a frame means suspended from the upper portion thereof. The frame means is powered to move to and fro within the washing compartment. A supply line for washing solution and a supply line for rinsing solution are secured to the frame means and are oriented peripherally about the washing compartment. Spray heads are located in each of the washing and rinsing solutions such that the washing or rinsing solution can be released from the respective conduit while the frame means and the conduits themselves are moving back and forth longitudinally within the washing station. In this manner complete washing and rinsing of an article having many difficult areas to clean such as a rack is achievable. The article may be admitted into the washing compartment through an entry opening in the front wall and leave through an exit opening in the rear wall or the article may be admitted and leave through the same opening. A door may selectively be positionable over the entry opening to prevent washing or rinsing solution from spraying into the surrounding area. The frame member may be mounted upon frame support means such as guide rods extending longitudinally through the housing along the ceiling surface thereof.

13 Claims, 1 Drawing Figure

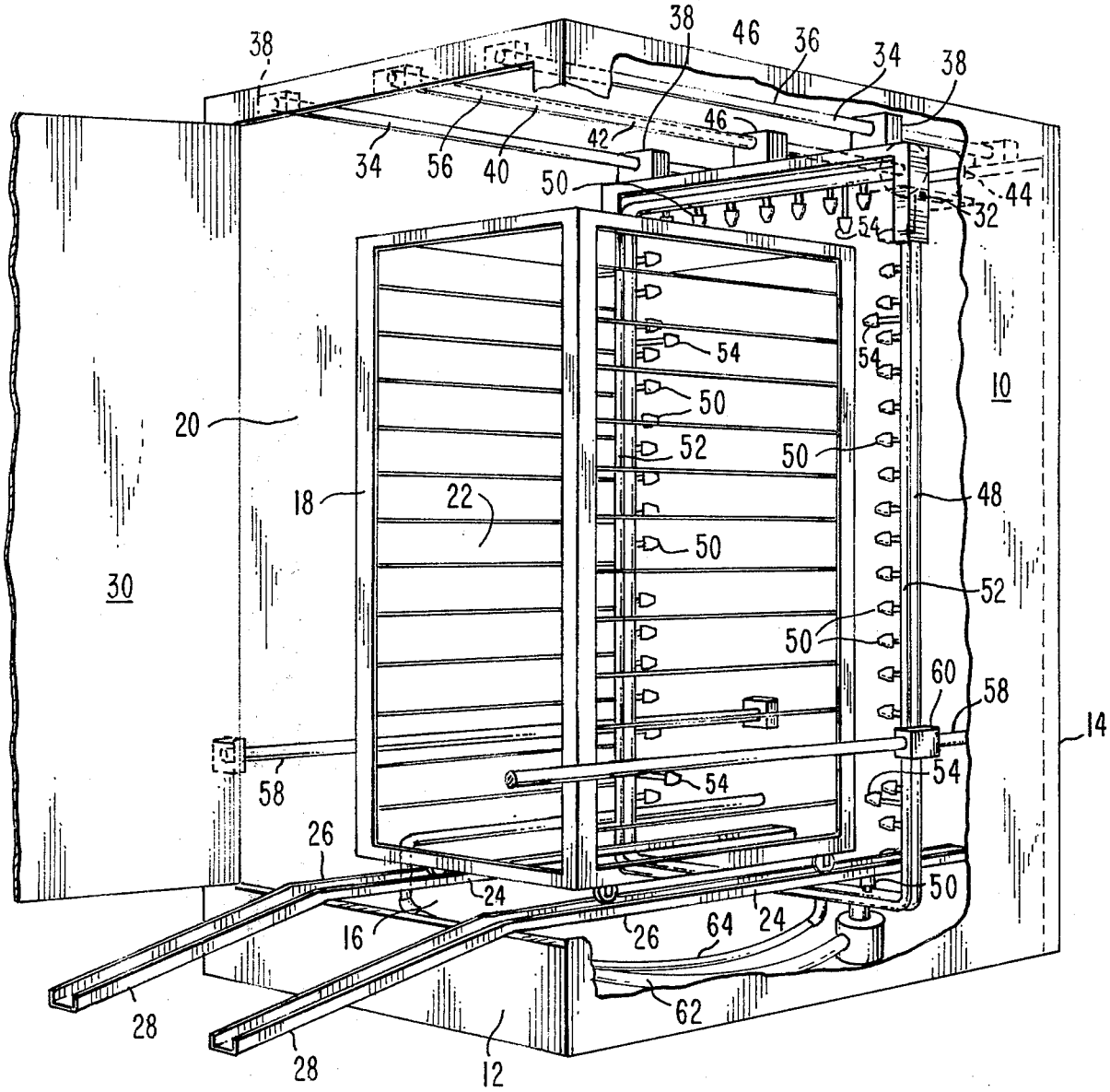
38
38
46
36
34
38
34
56
40
42
46
50
44
32
54
54
54
10
20
50
52
50
18
22
48
50
30
52
50
60
58
14
58
54
54
26
24
50
16
26
64
24
28
62
28
12

ARTICLE WASHING MEANS WITH MOVABLE SPRAY HEADS

BACKGROUND OF THE INVENTION

1. Field of the Invention

The present invention is usable for the washing of many different types of articles including hatchery racks, dolly washers, bakery racks, meat racks, incubator setter racks in the egg processing industry, baskets, smoke trees, farm pick-up racks, buggies, and other types of racks or carts. The present invention is usable within a conveyor system where the rack is moved along a line or can be usable as a fixed single installation where the articles to be washed are entered into the washing compartment from one side and removed from the same side. Under both of those environments, the present invention is particularly usable. The present invention provides very little line space in a line system due to the movable nature of the washing and rinsing heads. Also, speed is achieved in the washing and rinsing operation due to the complete peripheral location of nozzles for dispensing of each solution.

2. Description of the Prior Art

Prior art devices have been patented such as U.S. Pat. Nos. 2,699,792 to Fisher; 2,827,064 to Heinicke; 3,656,493 to Black et al; 3,706,317 to Fox et al; 4,019,458 to Kolterer; 4,076,033 to Busse et al; 4,227,938 to Fowler; and 4,287,901 to Fowler. These designs show different types of apparatus for washing buggies, trays, and racks, however, none show the capability of stationary or moving operation with washing and rinsing heads both in a moving motion and moving over the same line section.

SUMMARY OF THE INVENTION

The present invention provides an article washing means having movable spray heads which include a housing means having a front wall and a rear wall with the front wall defining an entry opening throughwhich an article is moved to be placed into the washing compartment. The washing compartment defined within the housing means to contain the washing and rinsing solutions being sprayed. Along the bottom portion of the housing means an article support means is positioned extending longitudinally therethrough. This article support means may take the form of a platform means to elevate the article to be washed above the floor to facilitate cleaning of the underside of the article.

A frame may be secured to the interior of the housing means and be longitudinally movable therein to and fro between the front and rear wall. A frame support means may extend from the front to the rear wall to facilitate this to and fro movement of the frame means. This frame support means may take the form of rods and may be adapted to extend through apertures defined within frame support guide means which themselves are fixedly secured with respect to the frame means. With this configuration, the frame means will be movable longitudinally to and fro between the front and back walls by movement of frame support guide means along the frame support means or rods.

To power movement of the frame means a drive shaft may be rotatably mounted within the washing compartment and extend longitudinally therethrough. This drive shaft should include a spiral groove therein. A drive means is secured with respect to the housing for driving selective rotation of the drive shaft. A drive follower is fixedly secured with respect to the frame and is movably secured with respect to the drive shaft. This drive follower preferably extends into the spiral groove means in the drive shaft such that when the drive shaft is driven in a rotary fashion the frame means will be caused to follow the spiral groove causing the frame to move forward and backwardly within the washing compartment. This can be further facilitated by having two spiral grooves defined in the drive shaft each extending in opposite spiral directions.

To perform the actual washing, a washing conduit means which carries washing solution therein under pressure should be fixedly secured with respect to the frame means and should extend peripherally around the location of an article to be washed. In this manner a very thorough cleaning of the article will be achieved. The washing conduit should also extend below the platform means to thereby facilitate cleaning of the underside of the article to be washed. To dispense the washing solution a washing spray means in the form of nozzles is secured into the washing conduit at selective locations thereon and is in fluid flow communication with respect to the washing solution therein for spraying the pressurized solution onto the article to be washed.

Similarly, a rinsing conduit means is defined for carrying rinsing solution. The rinsing conduit as well as the washing conduit is fixedly secured with respect to the frame to be longitudinally movable therewith and efficiently wash an article positioned within the compartment. The rinsing spray means in the form of nozzles is secured at various locations to the rinsing conduit to dispense the pressurized rinsing solution located therein.

Washing solution is provided to the washing conduit by a flexible washing supply line. This supply line is secured to the housing and secured to the washing conduit and therefore the inherent flexibility thereof allows it to move to and fro and maintain the flow of washing solution to the conduit during movement of the frame member. In a similar manner, a flexible rinsing supply line is secured fixed with respect to the housing and with respect to the rinsing conduit to supply rinsing solution thereto during longitudinal movement of the frame member. The inherent flexible nature of the rinsing supply line itself allows for this flexible coupling.

It is an object of the present invention to provide an article washing means which is particularly usable for the efficient washing of hatchery racks, bakery racks and meat racks.

It is an object of the present invention to provide an article washing means having movable spray heads to provide increased cleaning capacity within a very small spatial area.

It is an object of the present invention to provide an article washing means particularly usable with a continuous conveyor system.

It is an object of the present invention to provide an article washing means having movable spray heads which can be a cabinet-type in-and-out same-side washing system.

It is an object of the present invention to provide an article washing means which provides increased cleaning capacity per dollar of investment.

It is an object of the present invention to provide an article washing means which provides complete washing and rinsing within the same area of a line conveyor system.

It is an object of the present invention to provide an article washing means with minimum maintenance requirements.

It is an object of the present invention to provide an article washing means which can be usable to admit steam or hot water for washing or rinsing.

It is an object of the present invention to provide an article washing means having a complete wrap-around washing and rinsing system for complete and efficient washing and rinsing.

It is an object of the present invention to provide an article washing means which eliminates conveyor obstructions to facilitate efficient washing and rinsing.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective illustration of an embodiment of an article washing means of the present invention showing movable spray heads.

DETAILED DESCRIPTION OF THE PREFERRED EMBODIMENT

The article washing means of the present invention includes movable spray heads mounted within a housing 10. This housing includes a front wall 12 and a rear wall 14 with the front wall defining an entry opening 16 therethrough. An article to be washed is placed into the washing compartment 22 within the housing 10 by moving it through the entry opening 16. After it is within the washing compartment 22, a door means 30 may be closed thereover to hold the washing solution from spraying into the surrounding environment.

An article to be washed such as a rack 18 after washing will pass outwardly through the exit opening 20 and continue down the processing line if the article washing means is being used within such a line. If not, the article 18 may be again moved outward through the entry opening 16.

Article 18 is elevated within the washing compartment 22 by placement upon an article support means 24. In one embodiment, this article support means 24 may be a platform means 26. This elevated platform will therefore hold the article more centrally within the washing compartment 22 to facilitate thorough and efficient washing and cleansing thereof and in particular washing and cleansing of the underside thereof. To facilitate movement of the article 18 onto the platform 26 a ramp means 28 may extend from the surrounding floor area through the entry opening 16 to the platform means 26. The article to be washed may then be guided up the ramp means 28 into the washing compartment 22.

A frame means 32 is movably secured within the housing 10. The frame means is preferably located in the upper portion thereof and is longitudinally movable to and fro with respect to the front wall 12 and the rear wall 14. This movement is facilitated by frame support means 34 which may take the form of frame support bars 36. A frame support guide means 38 is fixedly secured with respect to the frame 32 and extends about the frame support bars 36 in such a fashion that as the frame 32 is moved to and fro between the front wall 12 and the rear wall 14 it will be maintained in a vertical orientation. The washing solution is dispensed from conduits secured to the frame and in this manner the to and fro movement of the frame 32 will allow the conduits to pass over the article 18 and thoroughly wash and rinse same.

Power for the reciprocating movement of the frame means 32 is provided through a drive shaft 40. This shaft extends from the front wall 12 to the rear wall 14 and preferably takes the form of a reversing worm rod 56. Such a reversing worm rod as shown in the FIGURE of the present invention includes a spiral groove 42 extending in one direction and another spiral groove means wound in the opposite direction. A drive means 44 is secured with respect to the drive shaft 40 to cause rotation thereof and the drive follower 46 is fixedly secured with respect to the frame means 32 such that when the drive shaft 46 is caused to be rotated by the drive means 44 the drive follower will be positioned within one of the spiral groove means 42 and will cause the frame means to move in one direction. Once the drive follower 46 moves to the complete forward or rearward direction it will then move into the oppositely configured spiral groove means 42 and cause movement in the opposite direction. This will result in the reciprocating to and fro movement between the front wall 12 and the rear wall 14 of the washing and rinsing conduits as well as of the frame means 32.

A washing conduit means 48 is fixedly secured with respect to the frame means 32 and as shown in the FIGURE of the present invention is generally peripherally shaped to extend completely about the location of an article 18 when in position upon the platform means 26. In particular, the washing conduit means 48 includes a segment extending below the platform 26 to facilitate washing of the underside of article 18. Washing spray means 50 such as nozzles or the like are positioned throughout the washing conduit means 46 such that the washing solution under pressure is dispensed therethrough for cleaning of the article 18.

In a similar fashion, a rinsing conduit means 52 usually of a smaller diameter than the washing conduit extends adjacent to the washing conduit means and throughout the same path thereof. This rinsing conduit means includes a rinsing spray means selectively located thereon for dispensing of the rinsing solution to thoroughly remove all the washing solution from the article 18 when it is being washed. In this manner complete washing and rinsing is achievable.

Under operation conditions the washing conduit will be reciprocally moved from a position adjacent the front wall to a position adjacent the rear wall and after complete washing has been achieved the rinsing system will be activated causing rinsing solution to be passed through the rinsing spray heads 54 as the rinsing conduit means 52 is passed to and fro over the article 18. This reversing movement is caused by the reversing worm rods 56 and facilitates complete washing and rinsing of the article 18.

To further guide movement of the downwardly extending washing conduit means 48 and rinsing conduit means 52, a lateral support means such as a lateral support bar 58 is positioned extending between the front wall 12 and the rear wall 14 and at a lower position along the sidewalls of the housing 10. A lateral support guide means 60 may be fixedly secured with respect to the washing and rinsing conduits 48 and 62 in such a fashion as to maintain vertical orientation thereof during the to and fro movement of frame means 32.

It is necessary that a pressurized line be secured with respect to the washing liquid supply and rinsing liquid supply and that this be secured with respect to the housing as well as with respect to the moving washing conduit means 48 and rinsing conduit means 52. This is achieved by a flexible washing supply line 62 and a flexible rinsing supply line 64. The flexible washing supply line 62 is secured with respect to the housing and with respect to the washing conduit means 48. The flexible rinsing supply line 64 is fixedly secured with respect to the housing as well as with respect to the rinsing conduit means 52. In this manner the inherent flexibility of supply line 62 and 64 will maintain pressurized contact between the two liquid supplies and the washing and rinsing conduit means 48 and 52.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An article washing means with movable spray heads comprising:

(a) a housing means including a front wall and a rear wall and defining an entry opening in said front wall through which to move articles into said housing to be washed and rinsed, said housing further defining a washing compartment therein to contain washing and rinsing solutions being sprayed;

(b) article support means extending through said housing means and adapted to elevate an article to be washed above the floor of said washing compartment;

(c) a frame means secured to the interior of said housing means and being longitudinally movable therein from adjacent said front wall to adjacent said rear wall;

(d) at least one frame support means extending from adjacent said front wall to adjacent said rear wall, said frame support means being fixedly secured with respect to said housing means;

(e) a frame support guide means fixedly secured with respect to said frame means and movably secured with respect to said frame support means to guide said frame means in longitudinal movement along said frame support means within said washing compartment;

(f) a drive shaft rotatably mounted within said washing compartment and extending longitudinally therethrough, said drive shaft defining a spiral groove means extending therealong;

(g) a drive means secured with respect to said drive shaft to cause selective rotation thereof;

(h) a drive follower fixedly secured with respect to said frame means and movably secured with respect to said drive shaft, said drive follower extending into said spiral groove means of said drive shaft to urge said frame means to move longitudinally within said housing responsive to selective rotation of said drive shaft;

(i) a washing conduit means for carrying washing solution and being fixedly secured with respect to said frame means to be longitudinally movable therewith in said washing compartment, said washing conduit means extending peripherally around the location of an article to be washed for thorough cleansing thereof;

(j) a plurality of washing spray means each secured with respect to said washing conduit means and in fluid flow communication with respect to the washing solution thereof to deliver the solution to the article to be washed within said washing compartment;

(k) a rinsing conduit means for carrying rinsing solution and being fixedly secured with respect to said frame means to be longitudinally movable therewith in said washing compartment, said rinsing conduit means extending peripherally around a location of an article to be rinsed for thorough rinsing thereof;

(l) a plurality of rinsing spray heads each secured with respect to said rinsing conduit means and in fluid flow communication with respect to the rinsing solution thereof to deliver the solution to the article to be rinsed.

2. The article washing means as defined in claim 1 wherein said article support means comprises a platform means extending longitudinally through said housing at a location spatially disposed above the lowermost peripheral section of said washing conduit means and said rinsing conduit means to hold the article to be washed thereabove.

3. The article washing means as defined in claim 2 further including a ramp means extending through said entry opening to guide an article to be washed upwardly into said platform means.

4. The article washing means as defined in claim 1 wherein said housing means further includes an exit opening defined in said rear wall thereof throughwhich a finished washed article may be exited.

5. The article washing means as defined in claim 1 further comprising a door means selectively movable to a closed position over said entry opening.

6. The article washing means as defined in claim 1 wherein said spiral groove means of said drive shaft comprises a reversing worm rod having two oppositely oriented spiral grooves to selectively cause said frame means to move longitudinally within said washing compartment between said front wall and said back wall.

7. The article washing means as defined in claim 1 wherein said frame support means comprises two frame support bars extending longitudinally above said frame means and wherein said frame support guide means extends therearound.

8. The article washing means as defined in claim 1 further including a lateral support means fixedly secured to said housing and extending longitudinally through said washing compartment.

9. The article washing means as defined in claim 8 further including a lateral support guide means fixedly secured with respect to said washing conduit means and said rinsing conduit means and extending about said lateral support means to guide longitudinal movement of said washing conduit means and said rinsing conduit means within said housing.

10. The article washing means as defined in claim 1 further including a flexible washing supply means secured fixedly with respect to said housing means and with respect to said washing conduit means to supply washing solution thereto during longitudinal movement thereof.

11. The article washing means as defined in claim 1 further including a flexible rinsing supply line secured fixedly with respect to said housing means and with respect to said rinsing conduit means to supply rinsing solution thereto during longitudinal movement thereof.

12. The article washing means as defined in claim 1 wherein said washing conduit means is of greater internal diameter than said rinsing conduit means.

13. An article washing means with movable spray heads comprising:

(a) a housing means including a front wall and a rear wall and defining an entry opening in said front wall throughwhich to move articles into said housing to be washed and rinsed, said housing further defining a washing compartment therein to contain washing and rinsing solutions being sprayed, said housing further including an exit opening defined in said rear wall thereof throughwhich a finished washed article may be exited;

(b) article support means extending through said housing means and adapted to elevate an article to be washed above the floor of said washing compartment, said article support means including a platform means spatially disposed above the washing compartment floor;

(c) a ramp means extending through said entry opening to guide an article to be washed upwardly onto said platform means;

(d) a frame means secured to the interior of said housing means and being longitudinally movable therein from adjacent said front wall to adjacent said rear wall;

(e) at least one frame support means extending from adjacent said front wall to adjacent said rear wall, said frame support means being fixedly secured with respect to said housing means, said frame support means comprising two frame support bars extending longitudinally above said frame means;

(f) a frame support guide means fixedly secured with respect to said frame means and movably secured with respect to said frame support means to guide said frame means in longitudinal movement along said frame support means within said washing compartment, said frame support guide means positioned to extend around said two frame support guide bars;

(g) a drive shaft rotatably mounted within said washing compartment and extending longitudinally therethrough, said drive shaft including a reversing worm rod having two oppositely oriented spiral grooves to selectively cause said frame means to move longitudinally within said washing compartment between said front wall and said rear wall;

(h) a drive means secured with respect to said drive shaft to cause selective rotation thereof;

(i) a drive follower fixedly secured with respect to said frame means and movably secured with respect to said drive shaft, said drive follower extending into said spiral groove means of said drive shaft to urge said frame means to move longitudinally within said housing means responsive to selective rotation of said drive shaft;

(j) a washing conduit means for carrying washing solution and being fixedly secured with respect to said frame means to be longitudinally movable therewith in said washing compartment, said washing conduit means extending peripherally around the location of an article to be washed including below said platform means for thorough cleansing thereof;

(k) a plurality of washing spray means each secured with respect to said washing conduit means and in fluid flow communication with respect to the washing solution thereof to deliver the solution to the article to be washed within said washing compartment;

(l) a rinsing conduit means for carrying rinsing solution and being fixedly secured with respect to said frame means to be longitudinally movable therewith in said washing compartment, said rinsing conduit being of a smaller internal diameter than said washing conduit, said rinsing conduit means extending peripherally around the location of an article to be rinsed including below said platform means for thorough rinsing thereof;

(m) a plurality of rinsing spray means each secured with respect to said rinsing conduit means and in fluid flow communication with respect to the rinsing solution thereof to deliver the solution to the article to be rinsed;

(n) a lateral support means fixedly secured to said housing and extending longitudinally through said washing compartment;

(o) a lateral support guide means fixedly secured with resepect to said washing conduit means and said rinsing conduit means and extending about said lateral support means to guide longitudinal movement of said washing conduit means and said rinsing conduit means within said housing;

(p) a door means selectively movable to a closed position over said entry opening;

(q) a flexible washing supply line fixedly secured with respect to said housing and with respect to said washing conduit means to supply washing solution thereto during longitudinal movement thereof; and (r) a flexible rinsing supply line secured fixedly with respect to said housing means and with respect to said rinsing conduit means to supply rinsing solution thereto during longitudinal movement thereof.

* * * * *